United States Patent [19]

Debrois

[11] 4,237,908

[45] Dec. 9, 1980

[54] METHOD FOR MANUFACTURING FILTER-TIPPED CIGARETTES

[75] Inventor: Pierre Debrois, Fleury-les-Aubrais, France

[73] Assignee: Service d'Exploitation Industrielle des Tabacs et des Allumettes, Paris, France

[21] Appl. No.: 14,285

[22] Filed: Feb. 22, 1979

[30] Foreign Application Priority Data

Feb. 24, 1978 [FR] France ..... 78 05307

[51] Int. Cl.[3] ..... A24C 5/47

[52] U.S. Cl. ..... 131/61 R; 131/33 R; 83/105

[58] Field of Search ..... 131/61 R, 61 A, 58, 131/29, 33–35, 76, 88, 15 B; 83/105

[56] References Cited

U.S. PATENT DOCUMENTS

| | | | |
|---|---|---|---|
| 1,545,634 | 7/1925 | Bird | 83/105 X |
| 3,805,800 | 4/1974 | Summers | 131/15 B X |

*Primary Examiner*—Stephen C. Pellegrino
*Attorney, Agent, or Firm*—Holman & Stern

[57] ABSTRACT

A method for manufacturing filter-tipped cigarettes, in which a band is wound on the end of the cylinder of tobacco and on the filter tip so as to encircle them and connect them together, wherein, on the path followed by the paper serving to constitute the band before winding and connection, the paper is slit longitudinally and the two edges of the slit are spaced apart in the direction of the longitudinal axis of the cigarette, as a function of the desired rate of dilution of the smoke.

3 Claims, 3 Drawing Figures

METHOD FOR MANUFACTURING FILTER-TIPPED CIGARETTES

The present invention relates to the manufacture of filter-tipped cigarettes, of the type comprising a cylinder of tobacco, or any other material which may be smoked, enclosed in a paper envelope, connected to a filter tip, these two elements being connected end to end and with the aid of a connecting band encircling both elements at least at their join.

It is an object of the present invention to manufacture such cigarettes in which means are provided which allow the admission of outside air into the body of the filter, and which thus ensure a dilution of the stream of primary smoke, cooling thereof and an improved condensation of the tars on the filtering material.

It has already been proposed to provide at least one additional outside air inlet zone (or ventilation zone) which concerns, over a given width normally occupied by the band, all or almost all of the circumference of the filter; this ventilation zone not being covered by the band, the outer face of the filter then communicates directly with the outside air.

To make such a ventilation zone, it has already been proposed to limit the band to a zone extending from the front end of the filter to approximately the centre of this filter and to insert the rear end of this filter in the actual sheath of the cigarette.

It has also been proposed to cover the end of the filter placed in the mouth by a band and to connect the filter to the cigarette by a second band.

A ventilation system has also already been proposed in which a virtually impermeable paper constituting the band covers a much more permeable paper. Holes in the outer paper allow the air to pass through both layers.

For the desired quantity of air to penetrate into the filter, this system requires that the permeability of the inside paper is relatively considerable. Now, the porosity of air-permeable papers cannot be ensured with precision, whilst the porosity of less permeable papers is much more constant in the whole of a reel and in the same manufacturing batch.

These methods are not easy to carry out and do not ensure a precise and stable adjustment of the dilution of the smoke by the outside air, at the desired rate.

To remedy these drawbacks, the invention provides to make a longitudinal slit in the band before winding it on the end of the cylinder of tobacco and on the filter tip so as to encircle one and the other and to space apart the two edges of the slit in the direction of the longitudinal axis of the cigarette, as a function of the desired rate of dilution of the smoke.

The method according to the invention enables a filter-tipped cigarette to be obtained simply and economically, which comprises an additional outer air inlet zone over the whole circumference of the filter, of very clearly determined width.

It also enables the proportion of air entering the filter of the cigarette to be increased to the desired degree by using papers enveloping the filter which are of low but constant permeability and by making use of the surface of this paper not covered by the band.

This method presents the advantage of being able to make a precise and stable adjustment of the dilution of the smoke by the outside air at the desired rate, starting only from the air permeability of the paper enveloping the filter, without interaction with other factors. In fact, for an enveloping paper of given permeability, the surface of the uncovered zone is simply varied, it being more or less considerable depending on the desired rate of dilution, which may thus range from 0 to almost 100%.

Another advantage of the invention, as will be readily appreciated, is the saving made in the paper constituting the band, both from the quantitative and technical point of view. In fact, the use of a normal paper for the band, i.e. non-porous and non-perforated, dispenses with a sophisticated equipment and allows a considerable saving of time.

For carrying out the method according to the invention there may be provided on the circuit of the paper constituting the band, on the one hand at least one rotary cutter adapted to slit the paper in the longitudinal direction and, on the other hand, following this cutter, means for spacing apart the slit, comprising for example at least one elastic blade adapted to be spaced apart form its normal position, for example by a cam acting on its free end.

The invention will be more readily understood on reading the following description with reference to the accompanying drawings, in which.

Figure 1:
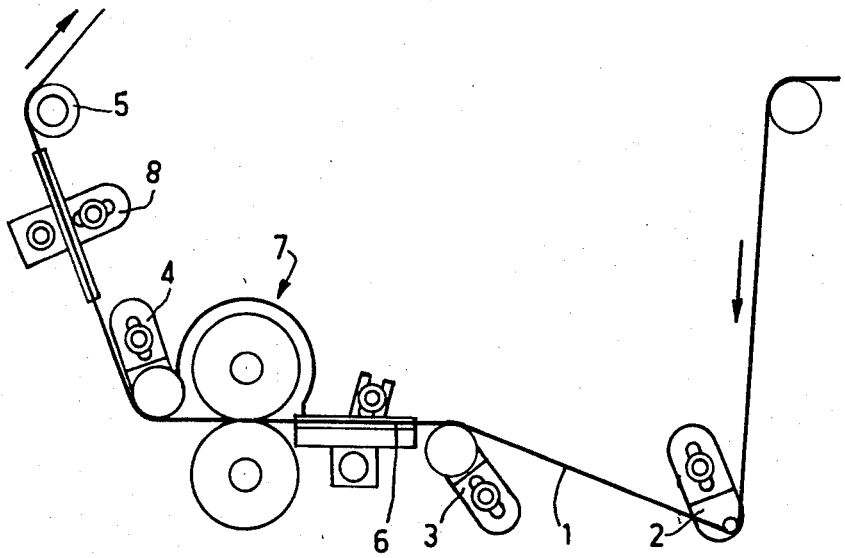
FIG. 1 is a schematic view of the whole device.
Figure 2:
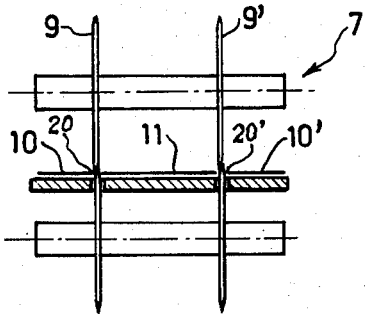
FIG. 2 is a schematic view in section of the means for cutting the paper constituting the band.
Figure 3:
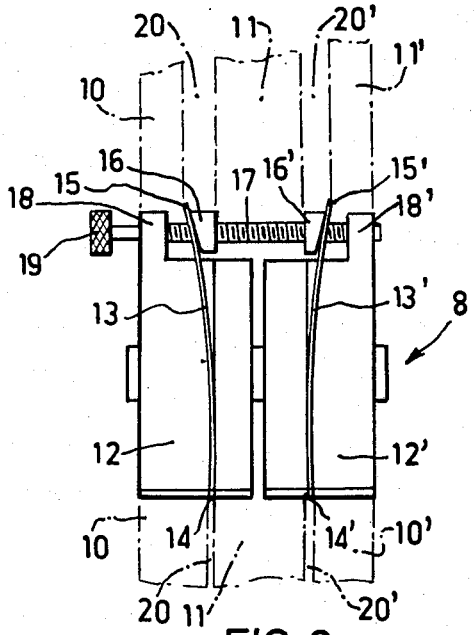
FIG. 3 is a schematic plan view of the means for spacing apart the slits.

It is known that filter-tipped cigarettes are manufactured in two's the connecting band joining two cigarettes.

The device shown in the drawing is therefore provided to produce and space apart two slits in the same paper band.

FIG. 1 shows only the part of the band paper circuit on which the means of the device according to the invention are mounted.

On this circuit of the paper 1, in addition to the fibre breaker 2, the guides 3, 4 and 5 and the centering plate 6 provided on the known devices, there are disposed a group 7 of two rotary cutters and a spacer member 8.

The group of cutters 7 is constituted by two pairs of rotary discs 9, 9' which divide the paper for the band into two side strips 10, 10' and a central strip 11.

These three strips reach the spacer member 8 constituted by two plates 12, 12' carrying two elastic blades 13, 13' of which one of the ends 14, 14' is fixed and the other 15, 15' free. The said ends 15, 15' rest elastically against two cams 16, 16' mounted like nuts on a threaded shaft 17. This shaft 17 is mounted to rotate on bearings 18, 18' arranged at the ends of the plates 12, 12'. A knurled knob 19 allows the shaft 17 to be rotated and, consequently, allows the cams 16, 16' and therefore the ends 15, 15' of the blades 13, 13' to be spaced apart from each other.

When the paper arrives on the member 8, the central strip 11 is introduced between the two blades 13 and 13' and the side strips 10, 10' to the outside. The blades 13, 13' therefore provoke the spacing apart of the slits 20, 20' cut by the cutters 9, 9'.

After connection which is effected in manner known per se, the cigarettes are therefore provided with a filter of which the band is separated into two distinct strips covering the porous or perforated sheath of the filter and leaving visible a ventilation zone of which the width has been adjusted with precision as a function of the desired rate of dilution of the smoke.

What I claim is:

1. A method of manufacturing filter-tipped cigarettes comprising the following steps:

(1) slitting a paper band longitudinally into at least a first and second strip;

(2) separating strips of paper a specific distance; and (3) wrapping a first portion of the filter with the first strip to create a first band and wrapping a second portion of the filter and a portion of a cylinder of tobacco with said second strip creating a second band spaced apart to create an exposed portion of the filter to allow air to enter the filter to dilute the smoke.

2. An apparatus for manufacturing filter-tipped cigarettes comprising:

means for feeding tobacco cylinders;

means for feeding filter cylinders;

means for feeding a band of paper;

rotary cutter means for longitudinally splitting said paper into first and second strips;

means for spacing apart said first and second strips; and means for wrapping said first strip around the forward end of said filter cylinder and wrapping said second strip around the backward end of a filter cylinder and the forward end of said tobacco cylinder, said first and second strip wrapped around said filter cylinder with an exposed portion of said filter cylinder therebetween.

3. The apparatus as claimed in claim 2 wherein means for spacing apart said first and second strips comprise at least one plate provided with an elastic blade wherein at least one end of the blade is fixed to said plate and said other end is free and rests elastically against an adjustable stop.

* * * * *